United States Patent [19]

Kitamura

[11] Patent Number: 4,629,439

[45] Date of Patent: Dec. 16, 1986

[54] MUSIC BOX TOY

[75] Inventor: Yoshio Kitamura, Nagano, Japan

[73] Assignee: Kabushiki Kaisha Sankyo Seiki Seisakusho, Nagano, Japan

[21] Appl. No.: 555,725

[22] Filed: Nov. 28, 1983

[30] Foreign Application Priority Data

Feb. 25, 1983 [JP] Japan ..... 58-25815[U]

[51] Int. Cl.[4] ..... A63H 3/28; A63H 3/20

[52] U.S. Cl. ..... 446/300; 446/357; 446/358

[58] Field of Search ..... 446/150, 151, 152, 298, 446/300, 301, 330, 333, 336, 338, 339, 340, 341, 352, 354, 357, 358, 147, 149, 334, 335; 40/421, 422, 423, 424, 425

[56] References Cited

U.S. PATENT DOCUMENTS

| | | | |
|---|---|---|---|
| 299,015 | 5/1884 | Sales | 446/152 |
| 1,254,573 | 1/1918 | Burkart | 40/421 X |
| 1,352,368 | 9/1920 | Horsey | 40/421 X |
| 2,045,864 | 6/1936 | Miller | 40/421 |
| 2,500,106 | 3/1950 | Wehr | 446/357 X |
| 2,519,499 | 8/1950 | O'Sullivan et al. | 446/301 |
| 3,119,197 | 1/1964 | Adams | 446/147 X |

FOREIGN PATENT DOCUMENTS

| | | | |
|---|---|---|---|
| 962370 | 12/1949 | France | 446/152 |
| 474623 | 12/1953 | Italy | 446/152 |

*Primary Examiner*—F. Barry Shay

*Attorney, Agent, or Firm*—Sughrue, Mion, Zinn, Macpeak and Seas

[57] ABSTRACT

A music box toy comprises a casing (1), a music box (7) housed therein, a stationary toy member (1*a*) provided on a front surface of the casing, a converting mechanism provided in the casing for converting a rotational driving force derived from a power spring of the music box (7) into a vertical reciprocating driving force, a movable toy member including a head member (4) and a trunk member (3), the trunk member being operatively connected to the converting means to perform a reciprocating movement during an operation of the music box, the head member being rotatably supported by the trunk member.

4 Claims, 5 Drawing Figures

MUSIC BOX TOY

BACKGROUND OF THE INVENTION

This invention relates to a music box toy having a music box housed in a casing and a moving toy provided outside of the casing.

In the conventional music box toy which has a moving toy such as a doll or the like whose acting parts such as the arms and head are actuated by the driving force of the music box which is usually provided by a spiral spring. The movement of these acting parts is generally a simple rotary or swing motion. It is sometimes required, however, to provide a combined movement of such simple swing and rotary motions.

To allow such combined movement for the acting parts of the music box toy, it has been required to provide a complicated and relatively expensive mechanism.

SUMMARY OF THE INVENTION

An object of the present invention is to provide a music box toy which provides a combined movement of swing and rotary motion with a simple mechanism.

The above object can be achieved, according to the present invention, by a music box toy which comprises a casing, a music box housed therein, a stationary toy member provided on a front surface of the casing, means provided in the casing for converting a rotational driving force derived from a power spring of the music box into a vertical reciprocating driving force, a movable toy member including a first member and a second member, the first member being operatively connected to the converting means to perform a reciprocating movement during an operation of the music box, the second member being rotatably supported by the first member, and means for restricting the rotation of the second member within a predetermined range during the reciprocating movement of the second member.

DETAILED DESCRIPTION OF PREFERRED EMBODIMENT

Figure 1:
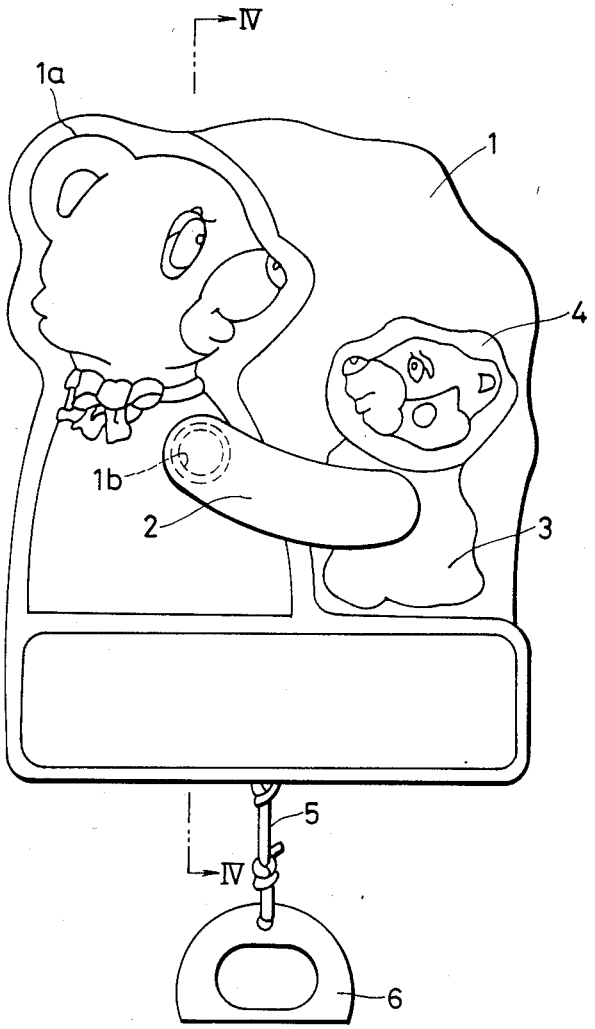
FIG. 1 is a front view of a music box toy according to an embodiment of the present invention.

Referring to the drawings, there is illustrated in FIG. 1 a music box toy according to an embodiment of the present invention which includes a casing 1 in which a music box 7 is housed. The music box may be any of the conventional ones which may be spring-powered.

On a front surface of the casing 1, a mother bear 1*a* is provided suitably, by, for example, embossing or painting. The mother bear thus provided functions as a stationary toy member.

A portion of the front surface 1*a* of the casing corresponding to a shoulder portion of the mother bear is opened with collars extending in opposite directions perpendicular to the front wall of the casing to form a through-hole 1*b*.

A movable toy member includes an arm portion 2 of the mother bear, a trunk portion 3 and a head portion 4 of a baby bear. The arm portion 2 and the trunk portion 3 are formed integraly as shown and the head portion 4 is pivotably supported eccentrically by the trunk portion 3.

At one end of the arm portion 2, an inwardly protruding portion 2*a* (shown in FIG. 4) is formed which is inserted into the through-hole 1*b* and rotatably supported thereby, so that the arm portion 2 of the mother bear can be swung therearound to provide a vertical movement of the trunk portion 3 of the baby bear which is integrally formed at the other end of the arm portion.

A string 5 is suitable engaged with a spring (not shown) of the music box 7 and suspended therefrom and a handle 6 is connected to the end of the string 5 to facilitate a pulling of the string 5 and hence a winding up of the power spring.

Figure 3:
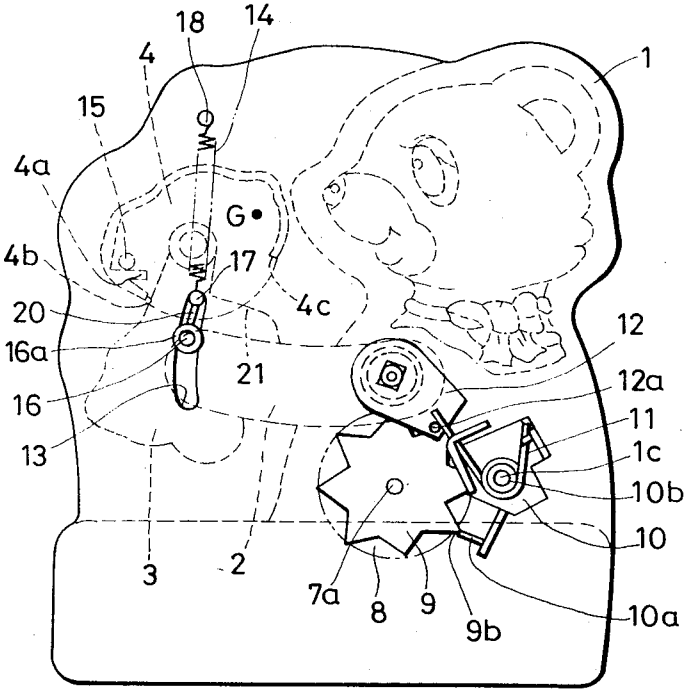
FIG. 3 is a rear view similar to FIG. 2, showing a mechanism being actuated state.

The embodiment of the present invention will be described in more detail with reference to FIGS. 2, 3 and 4.

Figure 2:
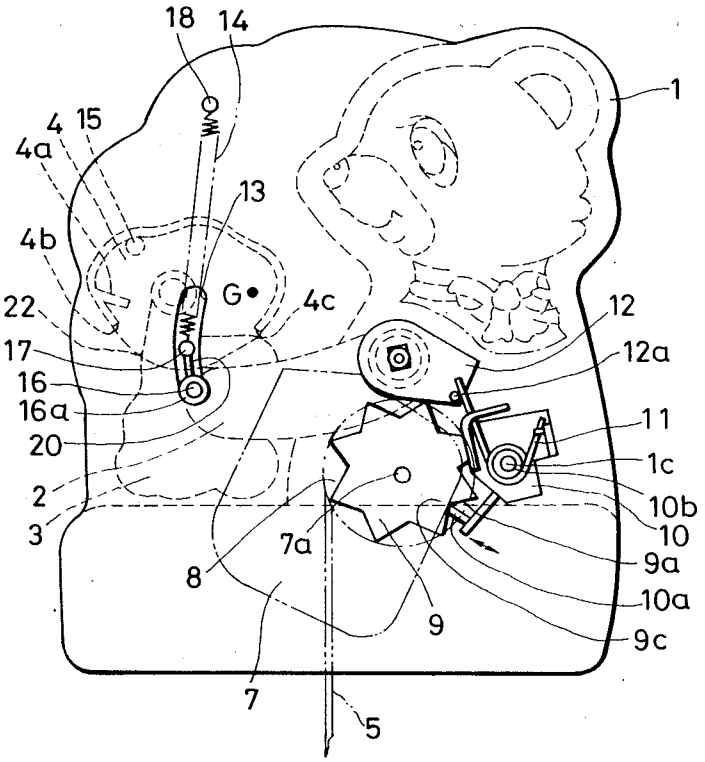
FIG. 2 is a rear view of the music box toy in FIG. 1 with a backwall of a casing of the music box toy being removed.
Figure 4:
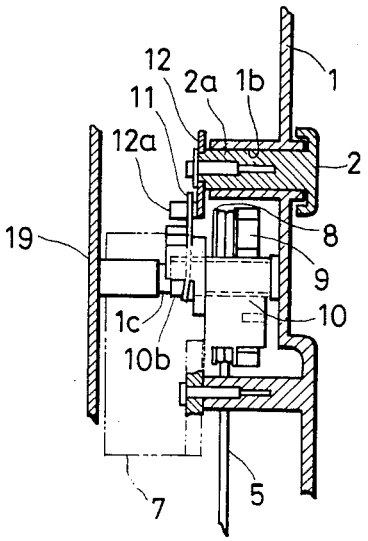
FIG. 4 is a cross sectional view taken along a line IV—IV in FIG. 1, showing a mechanism for providing the combined movement of the toy.

FIG. 2 is a rear side view of the music box toy with a rear cover 19 being removed to show a driving mechanism of this embodiment and FIG. 4 is a cross section taken along a line IV—IV in FIG. 1.

In FIGS. 2 and 4, the music box 7 has a winding pulley 8 on which the string 5 is suitably wound. The winding pulley 8 is fixedly connected to a widing shaft 7*a* of the music box 7 so that the winding shaft 7*a* is rotated integrally with the pulley 8 to wind up the power spring when the string 5 is pulled.

A star cam 9 is fixedly secured to the winding pulley 8 to provide a star cam surface 9*a* for an abutting portion 10*a* formed integrally on a pivot plate 10. At the center portion of pivot plate 10 is formed an upright tubular portion 10*b* if formed which fits on a shaft pin 1*c* implanted on a rear surface of the front wall of the casing 1 and is supported thereby rotatably.

A coil spring 11 is mounted around the tubular portion 10*b* of the pivot plate 10, so that the spring 11 biases the pivot plate 10 in a clockwise direction with the aid of end thereof being in contact with a pin 12*a* formed integrally with a lever 12 fixedly secured to the inward protruding portion 2*a* of the arm portion 2. (As used herein, "clockwise" and "counterclockwise" direction refers to FIGS. 1 and 5.)

Thus, when the music box 7 is actuated by the power spring thereof which is wound by pulling the string 5, the star cam 9 is rotated and the pivot plate 10 performs a rocking motion through the contact of the abutting portion 10*a* with the cam surface 9*a*. With the rocking motion of the pivot plate 10, the lever 12 is swung and thus the arm portion 2 is swung.

In order to stabilize the swing motion of the arm portion 2 and hence the trunk portion 3 of the baby bear, a pin 16 is formed integrally at a top end of the arm portion 2 and an arched slot 13 is formed in the front wall of the casing 1. The pin 16 fits in the slot 13 so that it is slidable therealong when the arm portion is swung. In order to prevent the pin 16 from getting out from the slot 13, a washer 16*a* is bolted to an end of the pin 16. If necessary, a spring 14 may be provided between a pin 18 implanted on the rear surface of the front wall of the casing 1 and a pin 17 formed integrally with the pin 16 to assist the swing motion of the arm portion 1. In this embodiment, the pin 17 is formed in parallel to the pin 16, the two pins being connected by an reinforcing member 20, so that both pins fit in the slot 13.

The head portion 4 of the baby bear which is rotatably supported by the trunk portion 3 thereof has a backwardly protruding flange portion formed along an upper portion of the periphery of the head portion 4. The backwardly protruding flange portion is shown by a dotted line in FIGS. 2 and 3 and has opposite ends 4*b* and 4*c*.

A point at which the head portion 4 of the baby bear is rotatably supported by the trunk portion 3 is eccentric with respect to the center of gravity G of the head portion 4 which is located at the side of the baby bear, such that the head portion 4 always tends to rotate clockwisely. The clockwise rotation of the head portion 4 is restricted by a contact of the end 4*c* of the backwardly protruding flange with a front shoulder portion 21 of the trunk portion 3 as shown in FIG. 2.

The backwardly protruding flange has an inward protrusion 4*a* formed in the vicinity of the other end 4*b* thereof and a pin 15 is formed on the front surface of the front wall of the casing 1. The inward protrusion 4*a* is adapted to contact with the pin 15 when the arm portion 2 and hence the trunk portion 3 of the baby bear are lifted up to a predetermined level, with the head portion 4 being rotated in a clockwise direction due to the eccentricity of the supporting point thereof.

When the inward protrusion 4*a* contacts with the pin 15, the clockwise rotation of the head 4 is restricted and the head portion 4 starts to rotate in a counterclockwise direction with a further upward swing of the arm portion 2. The counterclockwise rotation of the head portion 4 is restricted by contact of the end 4*b* of the backwardly protruding portion of the head portion with back side shoulder portion 22 of the trunk portion 3.

In operation, when the string 5 is pulled and the power spring of the music box 7 is wound, the music box starts to play music. At the same time, the star cam member 9 fixedly secured to the winding shaft 7*a* of the music box 7 starts to rotate. Therefore, the pivot plate 10 is rotated in a counterclockwise direction against the biasing force applied through the contact of the abutting portion 10*a* of the pivot plate 10 with the uprising portion of the cam surface 9*a* of the star cam member 9. The counterclockwise rotation of the pivot plate 10 is transmitted to the lever 12 through the contact of the pin 12*a* with the end of the spring 11 to cause the lever 12 to rotate in a clockwise direction.

The clockwise rotation of the lever 12 and hence the arm portion 2 causes the trunk portion 3 of the baby bear to be lifted up with the position of the head portion 4 with respect to the trunk portion 3 being fixed. When the cam member 9 further rotates and the contact point between the cam surface 9*a* and the abutting portion 10*a* of the pivot plate 10 reaches around a midway of the rising portion of the cam surface 9*a*, the inward protrusion 4*a* of the backwardly protruding flange of the head portion 4 comes into contact with the pin 15 provided on the front surface of the front wall of the casing 1 to start the counterclockwise rotation of the head portion 4 with respect to the trunk portion 3, i.e., a looking up motion of the baby bear.

With a further rotation of the cam plate 9, the head portion 4 is rotated in a counterclockwise direction while it is further lifted up by the arm portion 2. When the contact point between the rising surface of the cam 9 and the abutting portion 10*a* of the pivot plate 10 reaches around an apex portion of the cam surface 9*a* and the baby bear comes closer to the mother bear, the counterclockwise rotation of the head portion with respect to the trunk portion 3 is restricted by the contact of the end portion 4*b* with the back shoulder 22 of the trunk portion 3 as shown in FIG. 3.

During the contact point of the abutting portion 10*a* moves beyond the apex portion of the cam surface 9*a* and along the going-down cam surface thereof, the above-mentioned movements of the pivot plate 10, the lever 12, the arm portion 2 and the head portion 4 are reversed.

These movements of the various portions are repeated until the power spring of the music box 7 is discharged.

Figure 5:
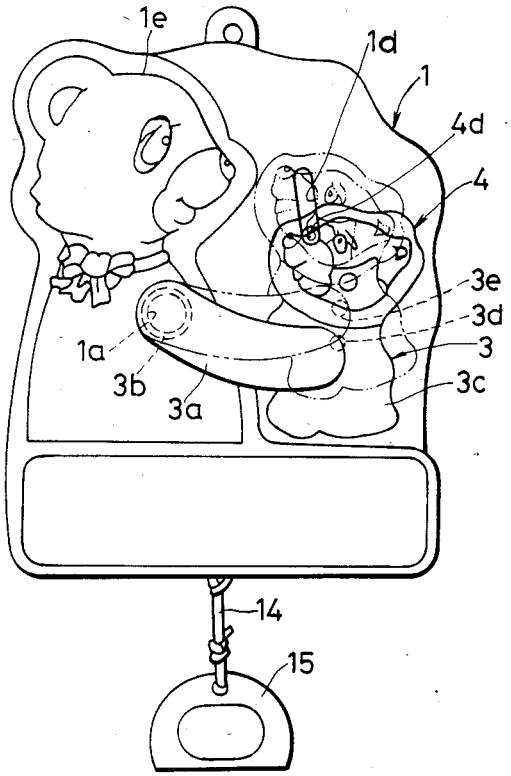
FIG. 5 is a front view of another embodiment of the present invention.

FIG. 5 shows another embodiment of the present invention in which the kissing motion i.e., the looking up motion of the baby bear is realized by a pin-slot engagement of a straight slot 1*d* formed in the front wall of the casing 1 and a pin 4*d* formed in the rear surface of the head portion of the baby bear. That is, the movement of the head portion 4 with respect to the trunk portion 3 of the baby bear is defined by the engagement of the straight slot 1*d* formed in the casing 1 with the pin 4*d* formed on the head portion 4 supported by the trunk portion 3 which moves along a portion of a circular locus having a center at the shoulder of the mother bear. This structure is simpler than that of the embodiment shown in FIGS. 1 through 4 although the kissing motion provided by the second embodiment is slower compared with that provided by the first embodiment in which the looking up motion of the head portion 4 is provided within a shorter time than that in the second embodiment.

As described hereinbefore, according to the present invention, the combined movement of the lifing up motion of the baby bear along a substantially linear line and the kissing motion, i.e., the swing motion of the head portion of the baby bear can be realized by a simple mechanism driven by the power spring of the music box.

What is claimed is:

1. A music box toy comprising a casing, a music box housed in said casing, means mounted in said toy for driving the music box thereof, including a power spring, means on said toy accessible from the exterior of said casing for winding said power spring, means provided in said casing for converting a rotational driving force derived from said power spring into a reciprocating driving force acting in a plane parallel to a front surface of said casing, a stationary toy member provided on said front surface of said casing, a toy member provided on said front surface of said casing mounted in a predetermined, movable relation to said stationary toy member, said movable toy member including a first member and a second member, said first member being operatively connected at a portion of said stationary toy member to said converting means to reciprocate said first member along an arc of a circle having a center at that portion of said stationary toy member and said second member being relatively rotatably supported by said first member, and means for restricting the rotation of said second member relative to said first member within a predetermined angle during a reciprocating movement of said first member.

2. The music box toy as claimed in claim 1, wherein said restricting means comprises a pin formed on an inner surface of said second member and a linear guide slot formed in said front surface of said casing, said pin being engaged with said linear guide slot and guided thereby to pivot said second member within a predetermined angle with respect to said first member during the reciprocating movement of said first member, the predetermined angle being determined by contacts of said pin with opposite ends of said linear slot.

3. The music box toy as claimed in claim 1, wherein said restricting means comprises a pin formed on the front surface of said casing and a flange formed integrally with an inside periphery of said second member, said flange being partially cut away to provide opposite end portions thereof and having an inward protrusion in the vicinity of one of said end portions, and wherein said second member is eccentrically rotatably supported by said first member so that said second member tends to gravitate rotationally in one direction, the rotation in that one direction being restricted by a contact of said first member with the other end portion of said flange, the rotation of the other direction of said second member being caused by a contact of said pin with said inward protrusion of said flange and restricted by a contact of said one end portion with said first member.

4. The music box toy as claimed in claim 1, wherein said stationary toy member is in the form of a mother bear, said first member is in the form of a trunk of a baby bear in combination of an arm of mother bear and said second member is in the form of a head portion of the baby bear and wherein an upward stroke of the reciprocating movement of said first member provides a lifting up motion of the baby bear by the arm of the mother bear and the rotational movement of said second member during the upward stroke of the first member provides a turning up movement of the baby bear to simulate a movement to kiss the mother bear.

* * * * *